US009016349B2

(12) United States Patent
Seitz

(10) Patent No.: US 9,016,349 B2
(45) Date of Patent: Apr. 28, 2015

(54) CUSTOMIZABLE DRAPERY SYSTEM AND METHOD

(76) Inventor: Richard T. Seitz, West Chester, OH (US)

( * ) Notice: Subject to any disclaimer, the term of this patent is extended or adjusted under 35 U.S.C. 154(b) by 99 days.

(21) Appl. No.: 13/093,826

(22) Filed: Apr. 25, 2011

(65) Prior Publication Data

US 2011/0284172 A1 Nov. 24, 2011

Related U.S. Application Data

(60) Provisional application No. 61/327,533, filed on Apr. 23, 2010, provisional application No. 61/414,233, filed on Nov. 16, 2010.

(51) Int. Cl.

| | |
|---|---|
| ***A47H 1/00*** | (2006.01) |
| ***A47H 13/00*** | (2006.01) |
| ***A47H 23/01*** | (2006.01) |
| ***A47H 23/02*** | (2006.01) |
| *A47H 23/00* | (2006.01) |

(52) U.S. Cl.

CPC ..... *A47H 23/01* (2013.01); *A47H 13/00* (2013.01); *A47H 23/02* (2013.01); *A47H 2023/003* (2013.01); *A47H 2201/01* (2013.01); *A47H 2201/02* (2013.01); *Y10T 29/49947* (2013.01)

(58) Field of Classification Search

USPC ..... 160/330, 368.1, 179, 123, 354; 5/486; 428/122, 57–62; 112/401

See application file for complete search history.

(56) References Cited

U.S. PATENT DOCUMENTS

| | | | | | |
|---|---|---|---|---|---|
| 1,778,499 | A | * | 10/1930 | King | 160/330 |
| 2,124,193 | A | | 7/1938 | Hennessy | |
| 2,500,074 | A | * | 3/1950 | Hill | 160/123 |
| 2,587,492 | A | * | 2/1952 | Lipetz | 160/124 |
| 2,594,624 | A | * | 4/1952 | Dubinsky | 160/123 |
| 2,609,043 | A | * | 9/1952 | Dubinsky | 160/124 |
| 3,321,003 | A | * | 5/1967 | Boerner | 160/237 |
| 3,434,525 | A | * | 3/1969 | Graff et al. | 160/388 |
| 3,883,381 | A | | 5/1975 | Thaeler | |
| 4,054,703 | A | * | 10/1977 | Boehm | 428/194 |
| 4,631,765 | A | * | 12/1986 | Casey | 5/417 |
| 4,878,258 | A | * | 11/1989 | Casey | 5/420 |
| 5,203,395 | A | * | 4/1993 | Koller et al. | 160/263 |
| 5,592,691 | A | * | 1/1997 | Ronald | 2/69 |
| 5,911,265 | A | * | 6/1999 | Dreher | 160/124 |
| 6,192,965 | B1 | | 2/2001 | Hinds | |
| 6,394,168 | B1 | | 5/2002 | Zoboski | |
| 6,517,922 | B2 | * | 2/2003 | Ang et al. | 428/41.8 |
| 6,866,082 | B1 | * | 3/2005 | Zahner | 160/390 |
| 7,350,244 | B1 | * | 4/2008 | Handley | 4/558 |
| 7,523,778 | B2 | | 4/2009 | Roberts et al. | |
| 7,686,062 | B1 | * | 3/2010 | Darnell | 160/330 |
| 7,909,082 | B2 | * | 3/2011 | Peoples | 160/123 |
| 2004/0209018 | A1 | * | 10/2004 | Lookholder | 428/33 |
| 2005/0011618 | A1 | * | 1/2005 | Kee | 160/179 |

(Continued)

FOREIGN PATENT DOCUMENTS

FR 2424009 * 4/1978

*Primary Examiner* — Blair M. Johnson

(74) *Attorney, Agent, or Firm* — Porter Wright Morris & Arthur LLP

(57) ABSTRACT

A drapery system for forming a window drapery of user-selected length. The system includes first and second drapery sections and at least one fastener for selectively and overlappingly attaching the drapery sections without stitching or sewing. A method of forming a drapery of user-selectable length is also provided.

22 Claims, 14 Drawing Sheets

(56) References Cited

U.S. PATENT DOCUMENTS

2007/0284058 A1 12/2007 Peoples
2008/0017328 A1 1/2008 Huang
2008/0017332 A1* 1/2008 Daly ..... 160/330
2010/0051210 A1* 3/2010 Daly ..... 160/113
2010/0051214 A1* 3/2010 Daly ..... 160/368.1
2010/0181032 A1 7/2010 Bennett et al.
2011/0168340 A1* 7/2011 Squillante ..... 160/330
2011/0284172 A1* 11/2011 Seitz ..... 160/123

* cited by examiner

CUSTOMIZABLE DRAPERY SYSTEM AND METHOD

CROSS REFERENCE TO RELATED APPLICATIONS

This application claims priority to U.S. Provisional Patent Application No. 61/327,533, filed on Apr. 23, 2010 and entitled Customized Drapery Sections, and to U.S. Provisional Patent Application No. 61/414,233, filed on Nov. 16, 2010 and entitled Customized Drapery Sections. The disclosures of both of the foregoing provisional patent applications are incorporated by reference herein.

BACKGROUND

The present disclosure relates to window draperies, curtains and the like, including the construction of customizable draperies in sectional form.

Homeowners will often spend significant amounts of money to purchase customized draperies for the windows in their home. Windows come in a wide variety of lengths, and are located at varying heights in a wall or other structure. In addition, homeowners may desire draperies which extend to the bottom edge of the window, all the way to the floor, or somewhere in between. Typically, the homeowner, or perhaps an interior designer, will measure the windows to determine the necessary or desired drapery length, select the fabric and style for the drapes, and then place on order with a custom drapery manufacturer. The manufacturer will then produce draperies to the requested specifications by precisely cutting fabric pulled from large rolls, and then precisely sewing one or more pieces of fabric to one another. It can take weeks for the homeowner to receive their drapes, and the customized nature of each drapery results in significant expense. In addition, because the draperies are stitched together, it is often impossible for the homeowner to later change the appearance or style of the draperies without ordering entirely new ones. Another option is for the homeowner to purchase pre-made, store bought drapes that come in only one size or a couple of limited stock sizes that do not properly fit the multitude of wall heights and window sizes in the typical home, and that cannot be customized to the desired size.

While a variety of drapery constructions and configurations may exist for providing draperies of various sizes, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings.

FIGS. 9*a* and 9*b* depict another embodiment of a customizable drapery system, wherein FIG. 9*a* shows a drapery section and hem member unattached, and FIG. 9*b* shows the hem member attached to the drapery section after the unfinished bottom end portion of the drapery section has been cut across its width.

Figure 1:
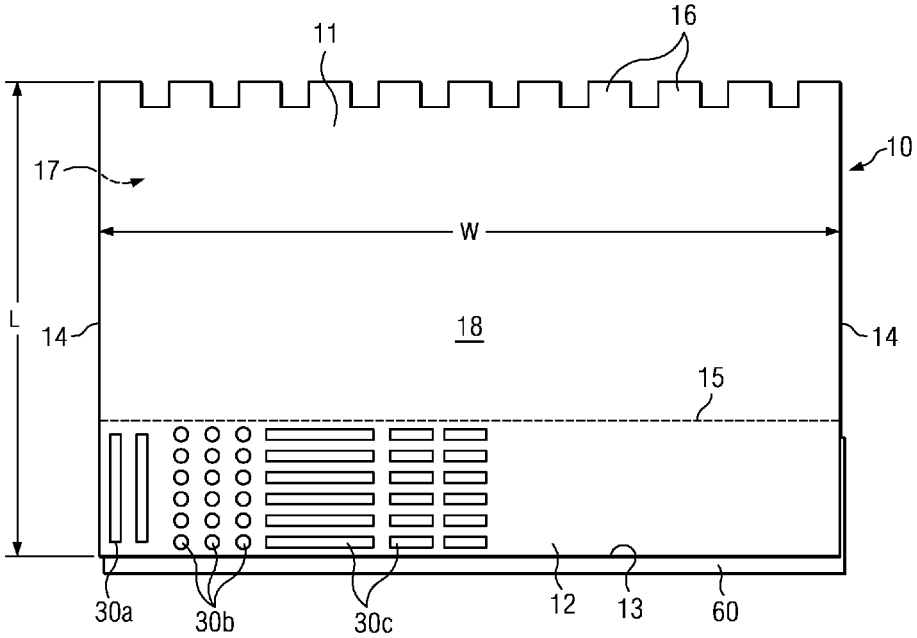
FIG. 1 depicts one embodiment of a first (in this example, a top) drapery section.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples should not be used to limit the scope of the present invention. Other features, aspects, and advantages of the versions disclosed herein will become apparent to those skilled in the art from the following description, which is by way of illustration, one of the best modes contemplated for carrying out the invention. As will be realized, the versions described herein are capable of other different and obvious aspects, all without departing from the invention. Accordingly, the drawings and descriptions should be regarded as illustrative in nature and not restrictive.

As used herein, the term "drapery" is used in its broadest sense, and therefore includes curtains, as well as other forms of window coverings and treatments, whether purely decorative, functional, or a combination of both. Also, while the embodiments depicted in the drawings are configured to be supported by (e.g., hung from) a drapery rod for positioning adjacent a window, the drapery systems described herein may be configured to be supported by a wall, window or other structure in any of a variety of ways. For example, the drapery system (e.g., a first or upper section of a drapery system) may be configured to be supported by a wall or window from a rod, a rail, a valence, various types of fasteners affixed to a wall or window, and other ways well known to those skilled in the art.

Embodiments further described herein provide a sectional drapery system which may be employed by an end-user to assemble a drapery of user-selected length or height, and which may be installed adjacent a window or other opening. By way of example, an end-user may purchase the drapery system packaged in kit form, or may purchase individual components of a desired color, pattern, fabric, style, etc. In one specific example, the drapery system includes two or more drapery sections having a predetermined length, wherein the end-user may cut one or more of the drapery sections to a desired length. Thereafter, the drapery sections are attached to one another, without sewing or stitching, in order to form a drapery for hanging adjacent a window. The final assembled drapery has a length determined by the end-user which is less than the combined, predetermined, manufactured length of the drapery sections. The drapery sections may also be finished along at least their side edges, the edge intended to form the uppermost edge of the assembled drapery, and the edge intended to form the bottommost edge of the assembled drapery. These finished edges may comprise, for example, one or more hemmed portions, stitched edges, etc. It should be noted that the term "end-user" is not limited to homeowners, and can include renters, interior decorators, home remodelers, home builders, and other entities (particularly persons other than the drapery manufacturer).

In some embodiments, the drapery sections may be removably attached to one another such that the end-user may later further shorten the drapery length, and/or change one or more of the drapery sections or other components of the drapery system, and/or alter the orientation of the drapery sections or other components. By way of specific example, one or more of the drapery sections may have different colors, patterns, fabrics or other styling on opposite sides, such that the end-user may disassemble the drapery, reverse the orientation of one or more of the drapery sections, and then reassemble the drapery to provide a different visual appearance. Similarly, the end-user may exchange one or more of the drapery sections to provide a different visual appearance or other feature. For example, one portion or section of the drapery may be changed with the seasons, for holidays, or for any of variety of other reasons.

Some embodiments are also configured such that, even though the end-user (e.g., a homeowner) shortens one or more of the drapery sections by widthwise cutting (e.g., using scissors or shears), the cut edge is hidden from view when the drapery is viewed from at least one side (and, in some embodiments, when viewed from both sides). For example, the drapery may be hung adjacent a window such that the cut edge and/or the attachment of adjacent drapery sections is not visible on the side of the drapery facing the interior of the room. In certain embodiments having two or more drapery sections attached to one another to form a drapery having upper and lower ends, one or more of the drapery sections are cut to the desired length at a location which is located between the upper and lower ends of the finished drapery. As a result, in some of these embodiments it is not necessary to finish the cut edge (e.g., with a stitched hem).

In addition, some embodiments are configured such that the assembled drapery will hang straight, with the outer edges of the assembled drapery extending vertical (i.e., vertically aligned with the window) even if one or more of the drapery sections has been cut by the user at an angle (i.e., the cut edge is not straight). In this manner, some embodiments allow the end-user to customize the length to match the size of the window or provide a desired drapery length, without the need for precise cutting, special tools and/or special skills. In fact, some embodiments described herein allow drapery customization using little more than a pair of scissors, and perhaps a measuring device (e.g., tape measure, ruler, etc.), a marking instrument (e.g., a pen or pencil suitable for drawing a line on fabric), and a straight edge (for drawing a reasonably straight line to guide cutting of fabric).

In some embodiments, the fastener(s) may be supplied in a drapery kit already attached to a plurality of drapery sections, attached to only one drapery section, or not attached to any drapery sections (such that the fastener(s) is attached by the end-user, such one or more adhesive strips).

I. Selectable, Overlapping Attachment of Drapery Sections

In the embodiment shown in FIGS. 1-8, the depicted drapery system includes a plurality of sections which are adjustably (and in some instances removably) attached together along at least a line extending across the width of one of the drapery sections. The sections may be provided in predetermined lengths (heights), and are attachable to one another at a plurality of locations to obtain a composite drapery of customized length selected, for example, by an end-user. The drapery system of FIGS. 1-8 includes a first (or top) drapery section (10, 110), a second (or lower) drapery section (20, 120), and one or more fasteners (30, 130, 40, 140) for selectively, and overlappingly attaching the first and second drapery sections to one another.

As best seen in FIG. 1, first (top) drapery section (10) has a length L (also referred to as the height) and a width W, and includes a head portion (11) and a bottom end portion (12) which terminates in a bottom edge (13). The head portion (11) includes one or more fixtures for supporting the top drapery section from a wall, a window or another structure. In the embodiment shown, head portion (11) is configured for hanging top drapery section (10), and hence the assembled drapery, from a drapery rod (2) that is secured to a wall (3), such as over a window casement (see FIG. 3). Loops (16) or sleeves are provided on the drapery fabric of head portion (11) of top section (10) through which the drapery rod is passed so that the drapery hangs from the rod (2). Alternatively, various other types of fixtures may be employed, such as hooks, hooks and slots, hooks and eyelets, or other known means for mounting a drapery to a rod, a rail or other structure.

Bottom end portion (12) of top drapery section (10) extends between and within the side edges (14) of the top drapery section (10), from proximate the bottom edge (13) upwardly to a position (15) that is in between the bottom edge (13) and the head portion (11). By way of example only, the bottom end portion (12) may extend upwardly from bottom edge (13) by about 2 to 24 inches, and in other embodiments by about 3 to 12 inches.

Figure 2:
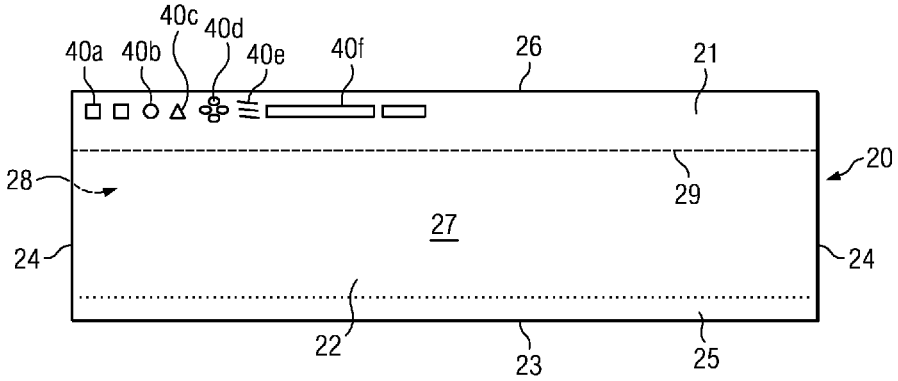
FIG. 2 depicts one embodiment of a second (in this example, a lower) drapery section which is selectively attachable to the first drapery section shown in FIG. 1.

The second (lower) drapery section (20) shown in FIG. 2 has a length which may be the same as, shorter than, or longer than that of top drapery section (10), and a width which is the same as the width of top drapery section (10). In the depicted example, lower drapery section (20) is shorter than top drapery section (10). Lower drapery section (20) includes an upper end portion (21) (also referred to as an upper adjustment portion) and a bottom portion (22) having a bottom edge (23). The bottom portion (22) can include a hem (25) provided along the bottom edge (23) which is formed, for example, using conventional stitching or sewing (with or without the use of additional fabric attached along bottom edge (23)). The upper end portion (21) extends between and within the side edges (24) of the lower drapery section (20), from the upper edge (26) downwardly to position (29) that is between the upper edge (26) and the bottom portion (22). By way of example only, the upper end portion (21) may extend downwardly from upper edge (26) by about 4 to 24 inches, and in another embodiment by about 6 to 12 inches.

In the embodiments of FIGS. 1-8, one or more fastener(s) are provided for selectively and overlappingly attaching the first and second drapery sections (10, 20) to one another, without stitching or sewing, at one of a plurality of locations. The first drapery section (10) has a front surface (17) and a back surface (18), which is the surface viewed in FIG. 1. Similarly, the second drapery section (20) has a front surface (27), which is the surface viewed in FIG. 2, and a back surface (28). The fastener(s) is configured such that front surface (29) of second drapery section (20) may be attached to the back surface (18) of first drapery section (10), with the upper edge (26) of second drapery section (20) positioned at a user-determined height above bottom edge (13) of first draper section (10). In this manner, the length of the assembled drapery is dictated by the amount of overlap between the first and second drapery sections (10, 20). Cutting of the drapery sections is not necessary in order to adjust the length of the assembled drapery. It will be understood that the two drapery sections and fastener(s) may be configured in a variety of other ways to allow for selectable, overlapping attachment, such as attaching the back surface (28) of second drapery section (20) to the front surface (17) of first drapery section (10) in a similar manner.

In some embodiments, one or more fasteners are provided only on first drapery section (10) or second drapery section (20). By way of example, at least one fastener (30, 40) may be secured along the width of the bottom end portion (12) on the back surface (18) of first drapery section (10), or along the width of the upper end portion (21) on the front surface (27) of second drapery section (20). In some embodiments, the at least one fastener for attaching the first and second drapery sections is an adhesive fastener, such as a strip or region of glue or adhesive tape. Thus, one or more such adhesive fasteners may be provided on either (or both) bottom end portion (12) of first drapery section (10) or upper end portion (21) of second drapery section (20). Depending on the type of adhesive fastener employed, it may be sufficient to provide the adhesive fastener(s) on only one of bottom end portion (12) of first drapery section (10) and upper end portion (21) of second drapery section (20). In other embodiments, and as further described herein, first and second matingly engageable fasteners are provided on bottom end portion (12) of first drapery section (10) and upper end portion (21) of second drapery section (20), such that the drapery sections are overlappingly attached to one another by engaging one or more of the first fasteners with one or more corresponding second fasteners.

While FIGS. 1 and 2 depict a variety of differently shaped and configured fasteners (30, 40), these illustrations are merely intended to depict the wide variations contemplated for the fasteners rather than a specific embodiment having multiple fasteners of numerous different shapes and configurations. In addition, in most embodiments, one or more fasteners extend generally evenly across a majority of the width of first and/or second drapery sections (10, 20), such as shown in the more specific embodiment of FIGS. 1*a* and 2*a*, so as to provide supporting attachment across substantially the entire width of the drapery sections. In the examples shown in FIGS. 1 and 2, fasteners (30, 40) are not depicted on the right half of first and second drapery sections (10, 20).

In FIG. 1, various types and shapes of fasteners (30*a*, 30*b* and 30*c*) are shown. Depending on the type of fastener(s) employed, fasteners (30) provided on, or associated with, top drapery section (10) may comprise first fastener members which matingly engage corresponding second fastener members (40) provided on, or associated with, lower drapery section (20). In addition to adhesive fasteners described above, various types of mechanical fastening systems may be used such as buttons, snaps, catches (or latches), eyelets, rivets, interlocking fasteners (e.g., hook-and-loop fastening systems such as VELCRO®), or other types of frictional and/or tension fasteners, or fastening systems wherein mating, interlocking, or otherwise engaging first and second fastener members are employed (e.g., buttons on one drapery section and corresponding button holes on the other drapery section). Suitable interlocking fasteners include, for example, two piece fastening systems such as hook-and-loop fasteners (e.g., VELCRO®), as well as hook-and-hook fasteners (e.g., DUAL LOCK™ fasteners available from 3M).

As yet another alternative, magnetic fasteners may be provided, such that the fastener comprises a first fastener comprising a magnet member associated with one of the drapery sections, and a corresponding second fastener comprising a target member associated with the other drapery section. The target member may comprise a material which is magnetically attracted to the magnet member, such as a ferromagnetic (e.g., ferrous) material. In some embodiments, the magnet member comprises a neodymium magnet (or other type of rare-earth magnet, or other ferromagnetic material). Like some of the mechanical fastening systems (e.g., hook and loop fasteners) described herein, magnetic fastening allows for removable attachment of the drapery sections. In some embodiments, the magnet and target member(s) may be attached to either side of the drapery section using an adhesive or other suitable attachment means. Alternatively, some or all of the magnet and target member(s) may be located internally in one or both drapery sections, such as between opposing layers of fabric or other material. As yet another alternative, some or all of the magnet and target member(s) may be separate from the drapery sections and magnetically secured to each other on opposite sides of the assembled drapery with the overlapping portions of the drapery sections magnetically held between the magnet and target members.

As mentioned previously, some embodiments of the drapery system and kit described herein employ adhesive fastening such that the fastener comprises a first adhesive material associated with one of the drapery sections, and which may be used to adhesively engage the other drapery section and/or a second adhesive material or target member associated with the other drapery section. A target member may comprise, for example, a material attached to a drapery section which provides better adhesion to the adhesive material than the underlying fabric of the drapery section. By way of example, the at least one fastener may include a first fastener comprising an adhesive strip affixed to the top drapery section, and a second fastener comprising a target member affixed to the lower drapery section. It should also be pointed out that adhesive fasteners may be provided to an end-user already attached to the drapery section(s), or may be provided in a drapery kit unattached to the drapery section(s) (e.g., as one or more strips of double-sided adhesive tape) for subsequent attachment by an end-user. Release layers may also be provided over adhesive materials such that the end-user may peel off the release layer in order to expose the adhesive material. Suitable adhesive materials include any adhesive material (including adhesives, glues, epoxies, etc.) suitable for attaching the material used for the drapery sections and supporting the weight of the assembled drapery without pulling apart. Adhesive fasteners can include, for example, pressure-sensitive adhesives, thermally-activated adhesive (so-called hot-melt adhesives or iron-on materials), heat tape, or fabric adhesives, and with or without a release layer material as needed.

The fasteners for attaching first and second drapery sections (10, 20) may be configured in a variety of ways to allow for selective overlapping attachment of the drapery sections, thereby allowing the end-use to adjust the overall length of the assembled drapery by selecting the amount of overlap between the first and second drapery sections. In some embodiments, a plurality of fasteners are provided on bottom end portion (12) and/or upper end portion (21) at varying distances from bottom edge (13) and/or upper edge (26), respectively. In such embodiments, the amount of overlap, and hence the length of the assembled drapery, is adjusted based on which fasteners are used in attaching the first and second drapery sections. In other embodiments, one or more vertically-extending fasteners are provided on bottom end portion (12) and/or upper end portion (21), and are configured for selectable attachment of the first and second drapery sections at one of a plurality of locations along the length of the vertically-extending fasteners (e.g., attachment at a selected one of a plurality of locations along the length of one or both components of hook and look fasteners, such as shown in FIGS. 1*a* and 2*a*).

Figure 1A:
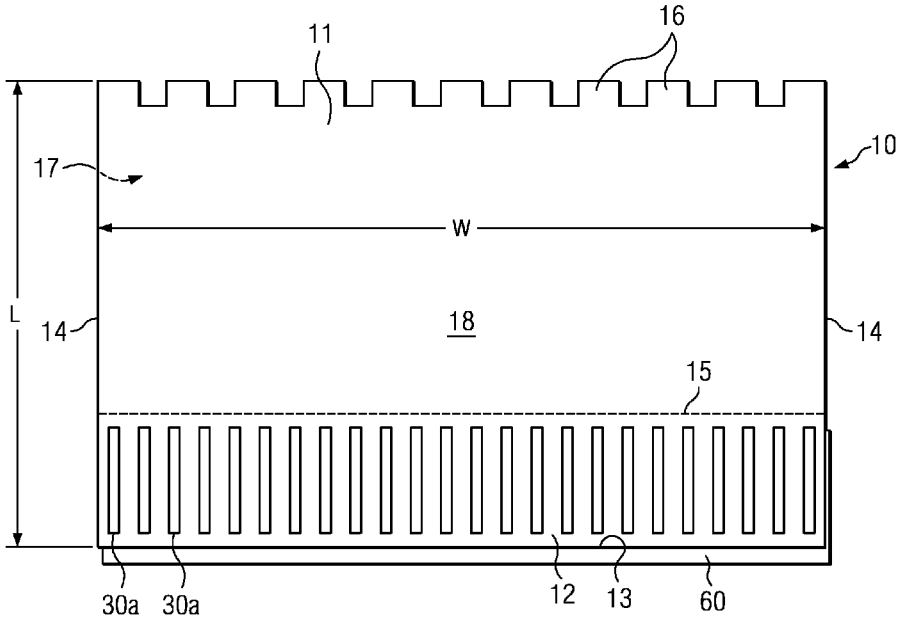
FIG. 1*a* depicts a more specific embodiment of the drapery section shown in FIG. 1.
Figure 2A:
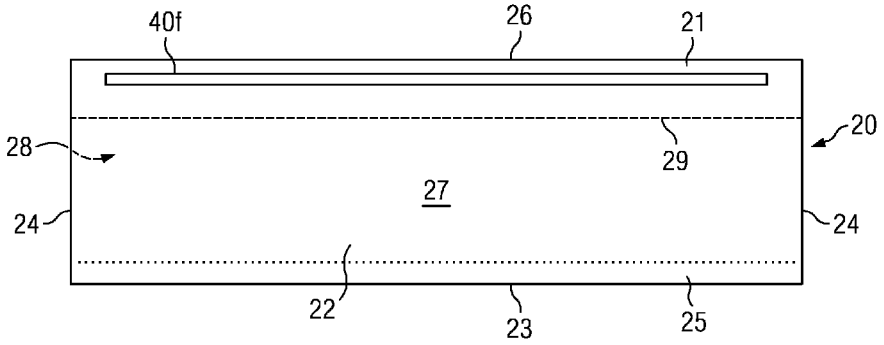
FIG. 2*a* depicts a more specific embodiment of the drapery section shown in FIG. 2.
Figure 3:
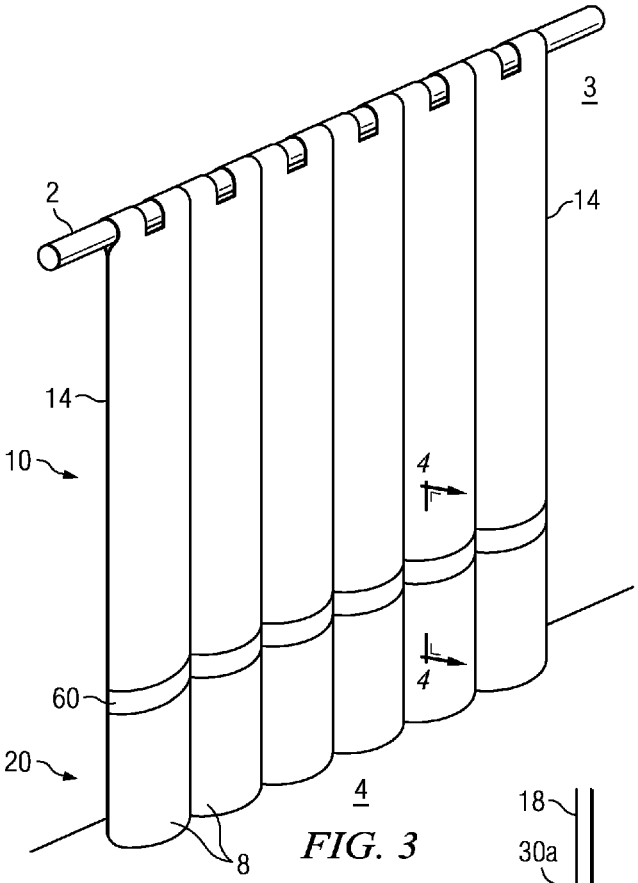
FIG. 3 depicts a perspective view of an assembled drapery system including the first drapery section of FIG. 1 and the second drapery section of FIG. 2 attached to one another.

In the specific embodiment shown in FIGS. 1*a* and 2*a*, for example, a plurality of elongated first fasteners (30*a*) extend vertically along the back surface (18) of bottom end portion (12) of the first drapery section (10). A series of such first fasteners (30*a*) are arranged across the width of bottom portion (12). Upper end portion (21) of second drapery section (20) may be overlappingly attached to the first fasteners (30*a*) at any of a plurality of locations along the length of first fasteners (30*a*). For example, if first fasteners (30*a*) comprise adhesive strips, the end-user may simply attach upper end portion (21) of second drapery section (20) at the desired location, with the upper edge (26) of second drapery section (20) located at any of a plurality of locations between bottom edge (13) and position (15) of first drapery section (10). Alternatively, second fastener (40*g*) shown in FIG. 2*a* may comprise a strip of adhesive material provided on the upper end portion (21) of second drapery section (20) in order to provide a more secure adhesive attachment.

As yet another alternative, first fasteners (30*a*) may comprise continuous strips of other types of fasteners, such as strips of Velcro®, magnetic strips, or other mechanical fastener elements. Second fastener member (40*f*) may comprise a matingly engageable fastener element, such as the corresponding Velcro® material (e.g., the hook or loop portion, depending on which is attached to first drapery section (10)), or the target member for magnetic fasteners (ferrous or magnetic). Thus, while a plurality of first fasteners (30*a*) are provided across the width of first drapery section (10) at a plurality of different heights, second fastener (40*f*) may be provided along the width of second drapery section (20) at a single height (i.e., at a single distance from upper edge (26)).

Of course it is also contemplated that first fasteners (30*a*) may be arranged as strips or other fastening regions which extend horizontally across the width of first drapery section (10) at a plurality heights (i.e., distances from bottom edge (13)), such as shown for fasteners (30*c*) in FIG. 1. First fasteners (30*a*) may also be configured as segments rather than continuous strips. Likewise, second fastener (40*f*) may instead be configured as a series of vertically-extending strips similar to first fasteners (30*a*) show in FIG. 1*a*, or as a series of horizontally-extending strips located at a plurality of distances from upper edge (26).

Of course any of a variety of other configurations may be employed in addition to the specific arrangement shown in FIGS. 1*a* and 2*a*. For example, first fastener (30*a*) in FIG. 1*a* may be replaced by a plurality of discrete, separate fasteners (30*b* in FIG. 1), arrayed in one more vertically-extending lines spaced across the width of bottom end portion (12), such as spots of two-piece interlocking fasteners (e.g., hook or loop spots of a Velcro® fastener), spots of adhesive, individual discrete magnets, spots of ferrous target material, buttons, snaps, catches (or latches), or eyelets. By way of further example, the discrete fasteners may be separated by a vertical distance, typically of at least a half inch and up to about 1-3 inches, or more. While the second fastener on second drapery section (20) may comprise strip (40*f*) or a plurality of fastener strips in various arrangements, a plurality of second fasteners (40) may be secured along the width of the upper end portion (21) of second drapery section (20), typically proximate the upper edge (26), for attachment to first fasteners (30*b*). These second fasteners may be provided as a single horizontally-extending row, or as a an array extending both horizontally and vertically along the width of upper end portion (21). Like first fasteners (30*b*), second fasteners (40) may be provided in a variety of shapes and locations, such as identified as (40*a*, 40*b*, 40*c*, 40*d*, and 40*e* in FIG. 2). Each of the second fasteners 40 is located for selective, mating engagement with at least one of first fasteners (30*b*) on first drapery section (10).

By way of specific example, first fasteners (30*b*) may be provided on bottom end portion (12) as a grid of discrete hook or loop spots (i.e., one half of a hook-and-loop fastening system), wherein these spots extend both vertically from bottom edge (13) and horizontally across the width of bottom end portion (12) of first drapery section (10). Corresponding second fasteners (40*b*) may be provided on upper end portion (21) as a horizontally-extending series of discrete hook or loop spots (i.e., the other half of a hook-and-loop fastening system), wherein second fasteners (40*b*) are in register with first fasteners (30*b*) (i.e., spaced across the width of second drapery section (20) the same as first fasteners (30*b*) are spaced across the width of first drapery section (10)). Thus, each column of first fasteners (30*b*) will have a corresponding second fastener (40*b*) in registry therewith. As yet another alternative, second fasteners (40*b*) may be provided in a grid patter similar to first fasteners (30*b*).

Figure 4A:
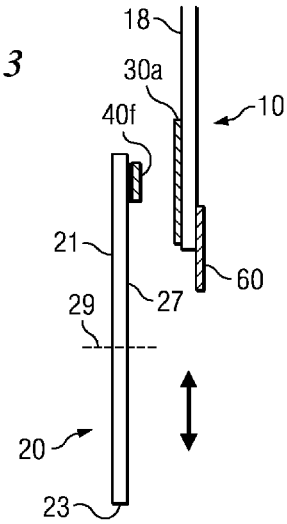
FIGS. 4*a* and 4*b* are sectional views of the embodiment shown in FIG. 3, taken through line 4-4 thereof of FIG. 1, before affirming of the drapery sections (FIG. 4*a*), and after the drapery sections have been affixed to one another (FIG. 4*b*).
Figure 4B:
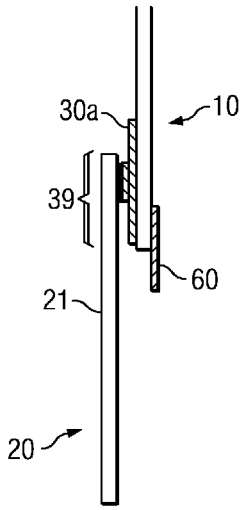

In a customized, assembled drapery shown in FIGS. 3, 4*a* and 4*b*, and 5*a* and 5*b*, the top drapery section (10) and the lower drapery section (20) of FIGS. 1*a* and 2*a* are shown assembled into a drapery unit, hanging from the drapery rod (2) and having a plurality of pleats (8). FIG. 4*a* shows a sectional view of the drapery system through line 4-4 of FIG. 3, with the drapery sections separated prior to assembly. In FIG. 4*a*, the front surface (27) of the lower drapery section (20) faces the back surface (18) of the top drapery section (10), and the second fastener element (40*f*) confronting the first fastener elements (30*a*) (with the section taken through one of first fasteners (30*a*)). FIG. 4*b* shows the two drapery sections attached together into a unit, by the affirming of the second fastener element (40*f*) to the first fastener elements (30*a*), at a user-selected height (in this particular example, second fastener (40*f*) is attached to first fasteners (30*a*) at approximately the midpoint of first fasteners (30*a*)), in overlapping arrangement. In FIGS. 4*a* and 4*b* the first fastener elements (30*a*) are vertically oriented fasteners, such as Velcro or adhesive strips, and second fastener (40*f*) is a horizontally-extending strip of mating Velcro or adhesive.

Figure 5A:
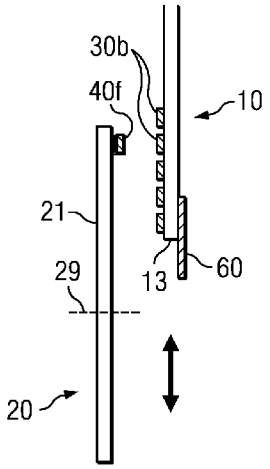
FIGS. 5*a* and 5*b* are views similar to FIGS. 4*a* and 4*b*, and depict an alternative embodiment of fasteners used to attach the first and second drapery sections.
Figure 5B:
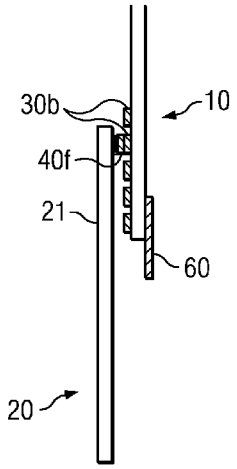

In the alternative embodiment of FIGS. 5*a* and 5*b*, the first fasteners (30*b*) are attached to bottom portion (12) as a grid of discrete, separated first fasteners (e.g., Velcro or adhesive spots), wherein the section of FIGS. 5*a* and 5*b* is taken through one vertically-extending line of first fasteners (30*b*). Second fastener (40*f*) is similar to second fastener (40*f*) in FIGS. 4*a* and 4*b*. A selected portion of the upper end (21) of the lower drapery section (20) overlaps behind a selected portion of the bottom end (12) of the top drapery section (10). The amount of overlap is selected by the user when sizing or installing the lower draper section (20) to the upper drapery section (10), typically determined by either design criteria or aesthetics, and by the height of the window or the distance that the bottom edge (23) is to be positioned above a location or surface, such as a floor (4).

In an alternative embodiment, the plurality of first fastener elements (30) secured to bottom portion (12) of the top drapery section (10) can comprise a plurality of continuous lateral (horizontally-extending) strips of fastener elements, extending along a portion of or the entire width of the top drapery section (10), and spaced apart vertically through the bottom portion (12). In another embodiment, the first fastener can cover substantially the entire area of the bottom portion (12), such as a rectangular adhesive region or a rectangular layer of Velcro material. In such an embodiment, the second fastener (40) secured to upper portion (21) of the lower drapery section (20) can comprise a continuous lateral strip or series of fastener(s), extending along a portion of or the entire width of the lower drapery section (20).

A third drapery section comprising a decorative band or strip of material (60) is shown, and is configured for attachment (either by a manufacturer or an end-user) to an end portion of one of the first and second drapery sections so as to conceal the edge of the end portion to which it is attached. In the embodiment shown in FIGS. 3-5, decorative material (60) extends along and overlaps the lower edge (13) of the top drapery section (10), and extends below the bottom edge (13) in order to disguise or conceal the line of overlap of the top drapery section over lower drapery section. The material (60) can be secured to top drapery section (10) adjacent the bottom edge (13) thereof by sewing or by other permanent fastening means, or by a temporary or releasable fastening means, including those described herein for the fasteners (30, 40). Alternatively, third drapery section (60) may be secured to the lower drapery section (20) adjacent the top edge (26) thereof. As yet another alternative, third drapery section (60) may be permanently or releasably secured to either the top or lower drapery section (10, 20) adjacent bottom edge (13) or upper edge (26), and user-securable to the other drapery section when the drapery is assembled (e.g., using one or more of the fasteners described herein).

As discussed above, the corresponding mating fasteners (30, 40) can include mechanical fasteners, magnetic fasteners, and adhesive fasteners. The first fastener elements (30) can be attached and secured to the second fastener elements (40), or optionally to the confronting drapery section directly, either permanently or removably. A permanent attachment or securement provides that the fastener is only removable or separable by destroying or damaging the fastener itself, and/or the fabric of the drapery section to which it is secured. The first fastener element and the second fastener element can be secured to the corresponding upper drapery section and lower drapery section, respectively, permanently, temporarily or removably, prior to their complementary securement to one another, or can be secured to the drapery sections at the time that the drapery sections are secured or attached to the other. Fasteners can be affixed or secured to the drapery sections by well known means, including using adhesives, riveting, stitching, etc.

The material from which the various drapery sections are made can include any fabric or other material suitable for draperies, including sheer fabrics, cloth, or other suitable drapery material. The materials for each section can be the same or different as that used for other sections, or even a combination of materials (e.g., two layers of fabric joined together, such as by stitching around their periphery).

In another embodiment, third drapery section (60) can serve both decorative and functional roles, such as attaching the first and second drapery sections. For example, third drapery section (60) can include one or more fasteners on a back surface thereof, such as along both the top and bottom edges of the back surface. The fasteners may be the same of different along the top and bottom edges. Depending on the type of fasteners employed, corresponding fastener elements may be provided on first drapery section (10) and/or second drapery section (20), positioned along the lower edge of or in a lower portion of the first drapery section and/or along the upper edge of or in an upper portion of the second drapery section. On the other hand, particularly if adhesive fasteners are provided on the back surface of third drapery section (60), no corresponding second fasteners may be required. Alternatively, the corresponding second fastener may be separate from the first or second drapery sections, such as a cap or backing member which can engage a first fastener such as a pin or barb that extends from the back of the third drapery section (60) and penetrates through the fabric of the first or second drapery sections, to be secured by the separate second fastener.

In another embodiment, additional sections of drapery may be added in between the illustrated top drapery section and bottom drapery section. In such embodiments, an intermediate drapery section can comprise an upper adjustment portion, as described above for the lower drapery section (20), and a bottom portion, as described above for the bottom portion (12) of the top drapery section (10), including the corresponding fasteners (30, 40). Thus, any number of additional drapery sections may be included, and attached to each other in any of the various ways described herein.

Figure 6:
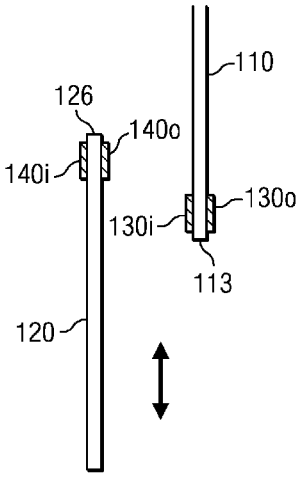
FIG. 6 is a view similar to FIG. 4*a*, and depicts a sectional view of yet another embodiment of first and second drapery sections, separated before affirming.
Figure 7:
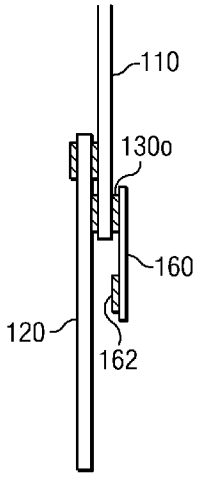
FIG. 7 is similar to FIG. 6, and depicts the first and second drapery sections affixed to one another in a first arrangement.
Figure 8:
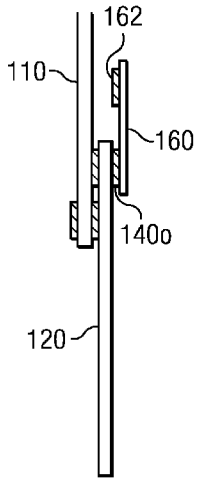
FIG. 8 is similar to FIGS. 6 and 7, and depicts the first and second drapery sections affixed to one another in a second arrangement.

By way of further example, in another embodiment shown in FIGS. 6, 7, and 8, a top drapery section (110) includes both outer and inner first fasteners (130*o*, 130*i*), positioned proximate the lower edge (113) on opposite surfaces of top drapery section (110). A lower drapery section (120) includes both outer and inner second fasteners (140*o*, 140*i*), positioned proximate the lower edge (126) on opposite surfaces of lower drapery section (120). In this embodiment, the fasteners may be selected depending upon the particular arrangement, and can include, for example a hook fastener and corresponding loop fabric material, and a thermally-activated or pressure sensitive adhesive. In one particular embodiment, the fasteners may comprise, for example, adhesive of Velcro strips extending across the width of the drapery sections (similar to fastener (40*f*) in FIG. 2*a*).

As shown in FIG. 7, the lower drapery section (120) can be adjusted to any overlapping position behind the top drapery section (110), and affixed thereto, wherein either or both the fasteners (140*o*, 130*i*) are secured directly to the fabric of the confronting drapery section. In FIGS. 7 and 8, a decorative band (160) can be optionally attached along one edge to the exposed fastener (130*o*, 140*o*), and can include an optional, auxiliary fastener (162) (e.g., an adhesive strip) that secures the other edge of the band 160 to the other fabric section (120, 110).

In the previously-described embodiments, the length of the assembled drapery is dictated by the amount of overlap of the first and second drapery sections. In other embodiments, the length of the assembled drapery may be dictated, at least in part, by how much of one or more drapery sections cut off by an end-user. For example, in the exemplary embodiment of FIGS. 1*a* and 2*a*, first fasteners (30*a*) may comprise adhesive strips, and second fastener (40*f*) omitted. While the end-user may alter the final length by changing the amount of overlap between first and second drapery sections (10, 20) when the drapery is assembled, the end-user may also cut off a portion of second drapery section (20). This may be accomplished, for example, by the end-user widthwise cutting across upper end portion (21) of second drapery section (20) along position (29), somewhere between position (29) and upper edge (26), or somewhere between position (29) and bottom edge (23). After cutting, the upper end of second drapery section (20) is affixed to first drapery section (10) in the same overlapping manner described previously using first fasteners (30*a*). In this manner, the length of the drapery is customized by removing material (e.g., fabric) from the middle of the drapery assembly. Similarly, the fasteners may be provided on second drapery section (20) (e.g., adhesive strips arranged similar to fasteners (30*a*) shown in FIG. 1*a* such that the lower end of first drapery section (10) is cut to length and then attached in overlapping arrangement to second drapery section (20) using the adhesive fasteners provided on the upper end portion (21) of second drapery section (20).

As mentioned above, when adhesive fasteners are used, a drapery kit comprising two or more drapery sections with one or more adhesive fasteners attached thereto, may be manufactured and sold as a kit or as individual components. Alternatively, the drapery sections may be manufactured and sold in a kit without the adhesive fasteners attached to either drapery section, but rather user-attachable adhesive fasteners such as one or more fastener strips (or a roll of adhesive strip) with adhesive provided on both sides (and covered by a release materials, such as waxed paper). Some embodiments employ adhesive strips having thermally-activated adhesives such that an end-user may attach the adhesive strip(s) (e.g., in the form of fastener (40*f*) in FIG. 2*a*) to one of the drapery sections using an iron, heat gun or other heat source, and/or attaching the drapery sections via the adhesive material using such a heat source to activate the adhesive.

II. Adjustable Length Drapery Having Edge Concealing Hem Member

Figure 9A:
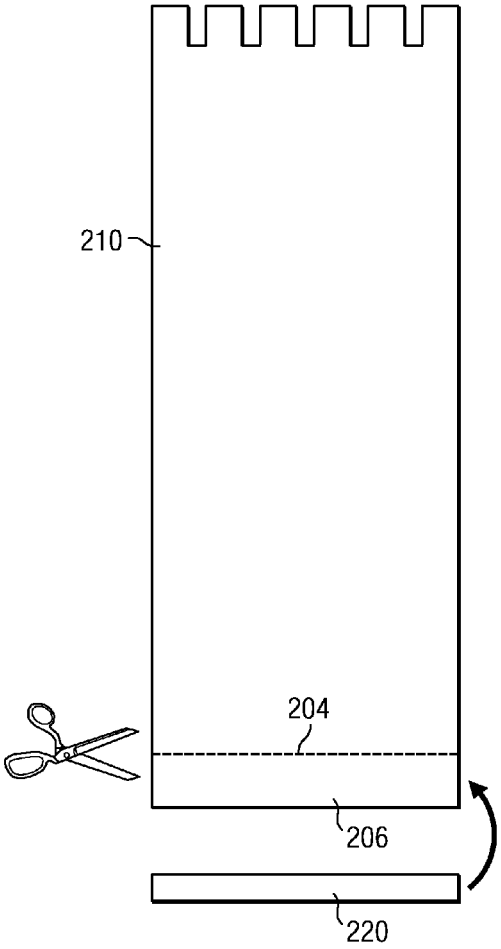
Figure 9B:
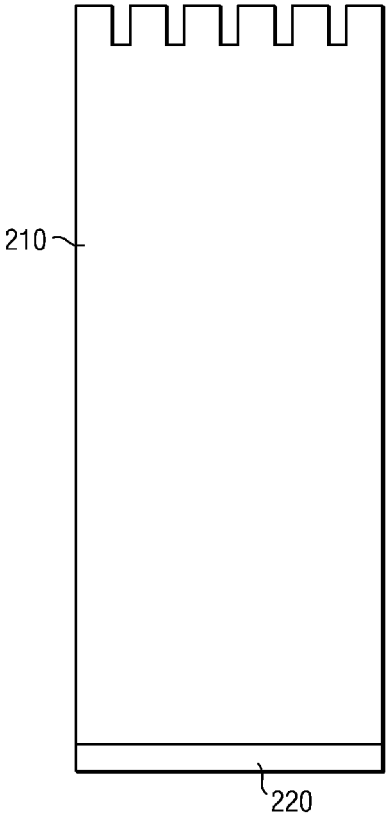

FIGS. 9*a* and 9*b* depict another embodiment of a drapery system having a user-selectable length when assembled. The customized drapery system or kit, and a method for customizing the length (height) of a drapery for any size window, area or opening, includes at least one drapery section (210) having a manufactured length, and a customizing hem member (220) that is attachable to the bottom of the drapery section (210) after removal by shearing of an extra length portion of the drapery section. As shown in FIG. 9*a*, drapery section (210) may be configured for hanging from a drapery rod (as described previously) or otherwise being supported from a wall, a window or other structure. Drapery section (210) may be manufactured in one or more predetermined lengths, and then shortened by the end-user as desired.

It will be understood that the drapery system shown in FIG. 9 may be configured to include any number of drapery sections, such as those described previously. Unlike some of the previously-described embodiments, the bottom edge of drapery section (210) is unfinished (does not include a hem or other finishing). Drapery section (210) may be widthwise cut by an end-user, such as along line (204) so as to remove extra length portion (206), thereby providing a drapery of the desired length which terminates in bottom edge (212) (see FIG. 10*a*). After cutting, the cut end can be custom-hemmed using the customizing hem member (220).

Figure 10A:
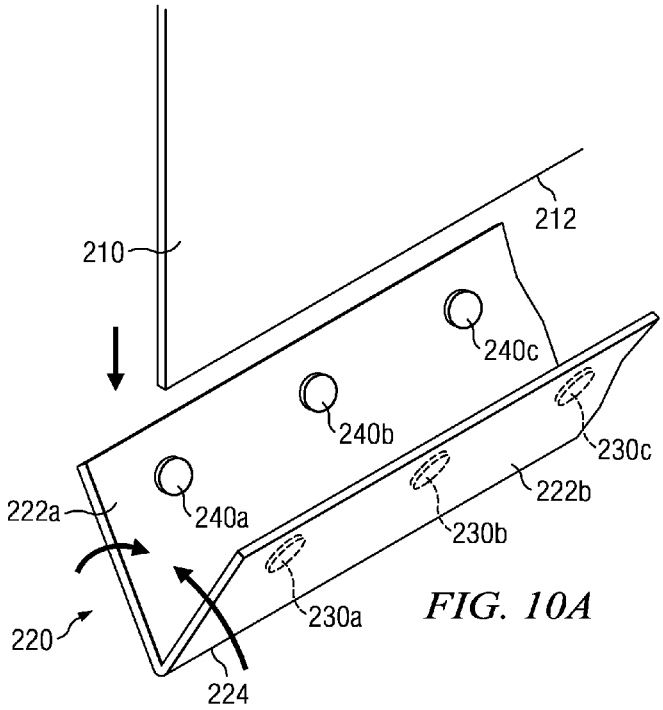
FIGS. 10*a* and 10*b* depict the attachment of the hem member of FIGS. 9*a* and 9*b* to the cut bottom end portion of the drapery section.
Figure 10B:
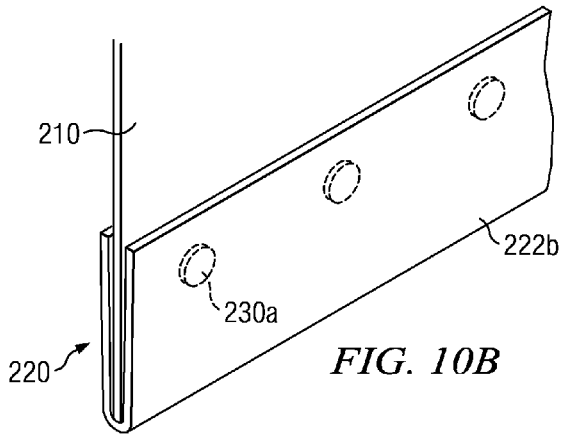

Customizing hem member (220), as best seen in FIGS. 10*a* and 10*b*, includes front and rear layers comprising a pair of substantially rectangular panels (222*a*, 222*b*) joined along one of their sides at a joint (224). Hem member (220) may be formed by folding a piece of fabric as depicted, or by attaching front and rear layers to one another (such as by stitching along corresponding bottom edges of the front and rear layers. Front and rear layers (222*a*, 22*b*) are in facing relationship, so as to provide a drapery section receiving pocket therebetween. The cut, unfinished bottom end portion of drapery section (210) adjacent cut edge (212) is inserted into the pocket provided between front and rear layers (222*a*, 222*b*), as shown in FIGS. 10*a* and 10*b*. One or more fasteners is also provided on hem member (220), configured for attaching the hem member (220) to the bottom end portion of drapery section (220). The at least one fastener may be any of the various fasteners described previously. In the embodiment shown, first fasteners (230) are provided on rear layer (222*b*) of hem member (220), and corresponding second fasteners (240) are provided on front layer (222*a*) of hem member (220), in registry with first fasteners (230). By way of more specific example, one of first and second fasteners (230, 240) may comprises magnet members (e.g., discs), while the other fasteners comprise ferromagnetic targets (e.g., discs which are magnetically attracted to the corresponding magnet members). In this manner, once the bottom end portion of drapery section (220) has been inserted between the front and rear layers (222*a*, 222*b*) of hem member (220), the front and rear layers are simply urged towards one another so that the magnets magnetically engage their respective targets, thereby retaining the bottom end portion of drapery section (220) between the front and rear layers (222*a*, 222*b*) of hem member (220).

Alternatively, first and second fasteners (230, 240) may comprise other types of fasteners such as adhesive materials for adhesively-engaging the bottom end portion of drapery section (220) between the front and rear layers (222*a*, 222*b*). Also, it will be understood that instead of discrete spots or other shapes of adhesive material, first and second fasteners (230, 240) may each comprise an adhesive strip located in facing relationship on the interior surfaces of front and rear layers (222*a*, 222*b*).

Customizing hem (220) can be made of any of a variety of decorative materials, including drapery material, cloth, fabric, molded or extruded plastics, fiberboard, and composite materials. In addition, when magnetic fastening or other removable fastening system is employed, the end-user may replace hem member (220) as desired (e.g., for aesthetic reasons). In addition, instead of cutting the bottom end of drapery section (210) to length, the bottom end may be widthwise folded to the desired length. Thereafter, the folded bottom end is inserted into the receiving pocket of hem member (220) and retained therein in the manner described previously. (Other embodiments described herein may similarly be modified such that the end of a drapery section is folded to the desired length, rather than being cut, and then attached to another drapery section by any of the variety of ways described herein.)

III. Customizable Drapery System Employing Fastening Section

A. Fastening Section on Lower Drapery Section

FIGS. 11 *a-d* depict another embodiment of a user-customizable drapery system. In this embodiment, the drapery system comprises first and second drapery sections, one of which includes a fastening section for attaching the first and second drapery sections to one another after the other drapery section has been cut (or folded) to length. In the embodiment shown, the fastening section includes the upper end portion of the second (or lower) drapery section, as described below. The lower end portion of the first (or top) drapery section is cut to the desired length, and the cut end is then attached to the second drapery section using the fastening section.

Figures 11A, 11B, 11C, 11D:
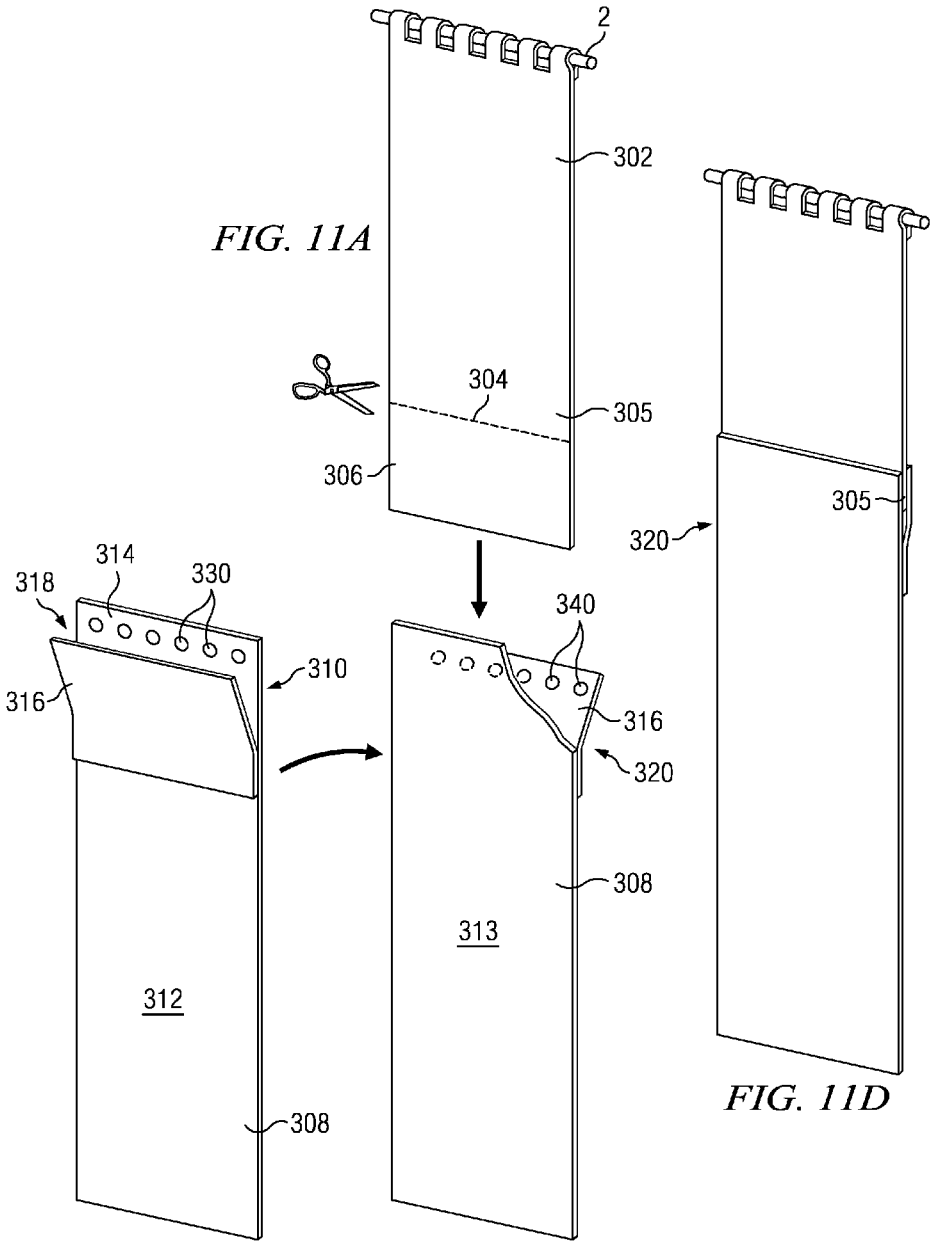
FIGS. 11*a*, 11*b*, 11*c* and 11*d* show a further embodiment of a customizable drapery system which includes first and second drapery sections, as well as a fastening section for attaching the first and second drapery sections after the first drapery section has been cut to a desired length by an end-user.

FIG. 11*a* depicts first (or top) drapery section (302) having a length and a width, and including a head portion similar to that described with respect to FIG. 1 for mounting to a drapery rod (2), and a bottom end portion (306). The bottom end portion (306) can be removed from the rest of first drapery section (302) along any desired line (304), depending upon the desired length of the assembled drapery, as described above.

FIGS. 11*b* and 11*c* depict back and front surfaces (312, 313), respectively, of a first (or lower) drapery section (308) having a length and width. Typically the width matches the width of the upper drapery section (302), and the length is a predetermined length selected by the manufacturer Like previous embodiments, the bottom edge, as well as the side edges of lower drapery section (308) are finished such as by stitching so as to provide a bottom hem and stitched sides. The upper edge of lower drapery section (308) may be finished as well. (The sides and upper edge of top drapery section (302) are also finished—only the bottom edge of top drapery section (302) is unfinished.)

A fastening section (310) is also provided and includes the upper end portion (314) of lower drapery section (308) and a strip of material (316) affixed to back surface (312) of lower drapery section (308), adjacent upper end portion (314) along a proximal edge of strip (316). The material strip (316) and the upper end portion (314) thus define a drapery section receiving pocket (or groove) (318) therebetween (similar to the drapery section receiving pocket of the hem member (220) described above).

As shown in FIG. 11*d*, after the bottom end portion (306) of top drapery section (302) has been cut to the desired length, the resulting cut bottom end (305) of the top drapery section (302) is positioned within the receiving pocket (318). First fasteners (330) are provided along the upper end portion (314), and as needed second fasteners (340) are provided on the strip (316) for retaining cut bottom end (305) of the top drapery section (302). Fasteners (330, 340) are secured to each side of the cut bottom end (305) of the top drapery section(302) (e.g., adhesive fasteners in the form of discrete spots or one or more elongate strips), or to one another through the cut bottom end (305) (e.g., magnetic fasteners, or mechanical fasteners which physically penetrate the fabric such as rivets or other pin-type fasteners), so as to form the customized assembled drapery (320) of customized length.

In the particular embodiment shown, one of fasteners (330, 340) comprise magnet members (e.g., neodymium magnet discs), and the other fasteners comprise magnetically-attractive target members aligned with the magnet members on the opposite layer of the fastening section (e.g., ferromagnetic discs). Of course any combination of magnet members and targets may be employed, such as a plurality of magnet members on one layer of the fastening section (strip (316) or upper end portion (314), and ferromagnetic strip extending widthwise across the other layer of the fastening section. As another alternative, magnet members may be provided on both layers of the fastening section, optionally with suitable target members interspersed on one or both layers. The fastener elements 330 and 340 can be one of the first fastener elements and/or second fastener elements described herein above. Of course other of the various types of fasteners described herein may be employed.

On advantage of using magnetic fasteners for fastening section (310) is that the cut bottom end of top drapery section (302) is not penetrated or otherwise damaged by the magnetic fasteners. Thus, lower drapery section (308) may later be removed from top drapery section (302). Thereafter, a different lower drapery section (308) may be attached to top drapery section (302), lower drapery section (308) or top drapery section (302) may be reversed (e.g., when the opposite surfaces of the drapery section have different patterns or colors, or when one surface becomes faded, damaged or soiled), or the top drapery section (302) may be further shortened by additional widthwise cutting. It will also be understood that instead of cutting the bottom end of top drapery section (302) to length, the bottom end may be widthwise folded to the desired length. Thereafter, the folded bottom end portion is inserted into the receiving pocket fastening section (310) and retained therein in the manner described previously.

B. Fastening Section on Top Drapery Section

Figure 12A:
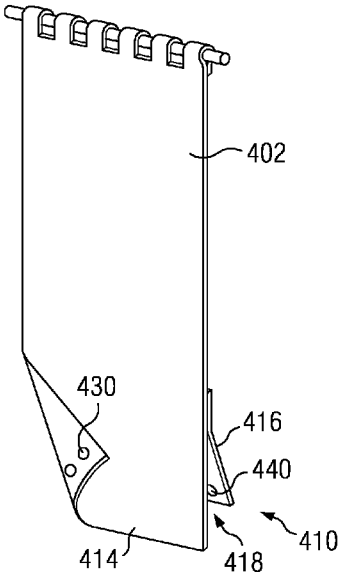
FIGS. 12*a*, 12*b* and 12*c* show still another embodiment of a customizable drapery system which includes first and second drapery sections, as well as a fastening section for attaching the first and second drapery sections after the second drapery section has been cut to a desired length by an end-user.
Figure 12B:
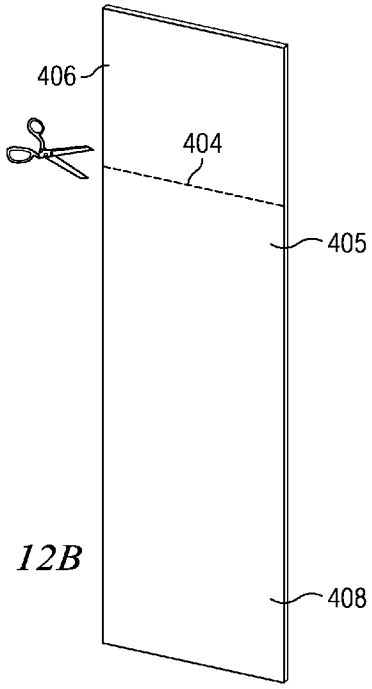
Figure 12C:
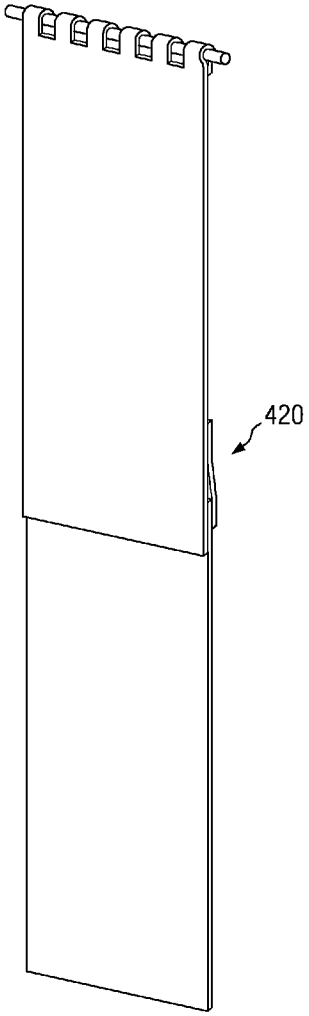

FIGS. 12*a-c* depict an alternative embodiment of a drapery system (420) wherein the fastening section the bottom end portion of the first (top) drapery section and the upper end of the second (lower) drapery section is cut to length and the cut end is then attached to the first drapery section using the fastening section.

FIG. 12*a* depicts first (or top) drapery section (402) having a length and a width, and including a head portion similar to that described with respect to FIG. 1 for mounting to a drapery rod, and a bottom end portion (414). FIG. 12*b* depicts second (or lower) drapery section (408), having an upper end portion (406) which can be removed from the rest of second drapery section (408) along any desired line (404), depending upon the desired length of the assembled drapery, as described above.

Like previous embodiments, the bottom edge, as well as the side edges of lower drapery section (408) are finished such as by stitching so as to provide a bottom hem and stitched sides. Similarly, the sides and upper and bottom edges of top drapery section (402) are also finished—only the upper edge of lower drapery section (408) is unfinished.

A fastening section (410) is also provided and includes the bottom end portion (414) of top drapery section (402) and a strip of material (416) affixed to the back surface of top lower drapery section (402), adjacent bottom end portion (414) along a proximal edge of strip (416). The material strip (416) and the bottom end portion (414) thus define a drapery section receiving pocket (or groove) (418) therebetween (similar to the drapery section receiving pocket of the embodiment shown in FIG. 11).

As shown in FIG. 12*c*, after the upper end portion (406) of lower drapery section (408) has been cut to the desired length, the resulting cut upper end (405) of the lower drapery section (408) is positioned within the receiving pocket (418). The cut upper end may be retained within receiving pocket (418) using one or more the various fasteners described previously with respect to the embodiment shown in FIG. 11 (or any other embodiments described herein).

C. Separate Fastening Section for Attaching First and Second Drapery Sections

FIGS. 13*a-e* depict yet another embodiment wherein the drapery system includes a separate fastening section for attaching first and second drapery sections to one another. In this embodiment, both the bottom end portion of the first (top) drapery section and the upper end portion of the second (lower) drapery section may be cut (or folded) by the end-user to the desired length.

Top drapery section (502) is configured similar to top drapery section (302) in FIG. 11, and includes a bottom end portion (504) which may be cut along line (504) in order to shorten the length of top drapery section (502). Lower drapery section (508) is similar to lower drapery section (408) in FIG. 12, and includes an upper end portion (507) which may be cut along line (514) in order to shorten the length of lower drapery section (508).

Figure 13A:
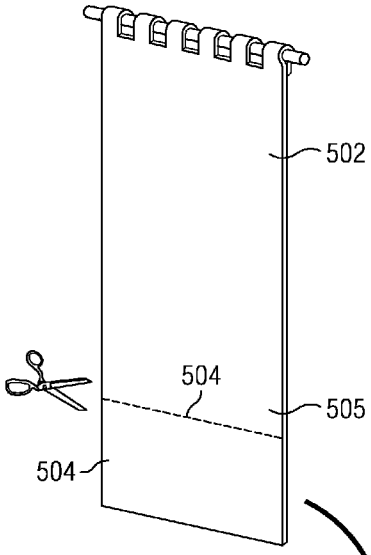
FIGS. 13*a*, 13*b*, 13*c*, 13*d* and 13*e* depict yet another embodiment of a customizable drapery system which includes first and second drapery sections, as well as a fastening section for attaching the first and second drapery sections after one or both of the drapery sections have been cut to a desired length by an end-user.
Figure 13D:
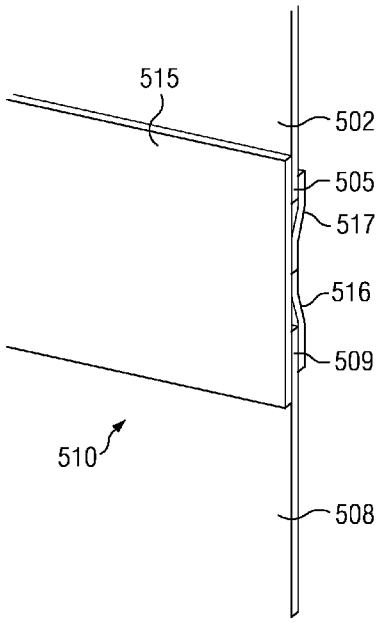
Figure 13C:
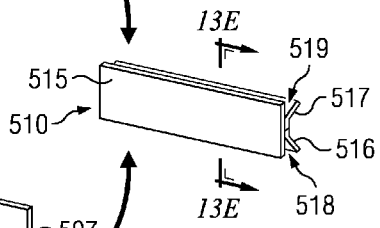
Figure 13B:
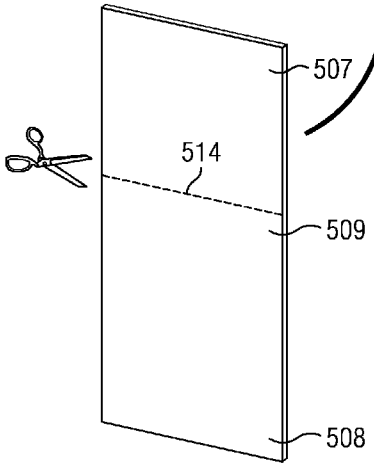
Figure 13E:
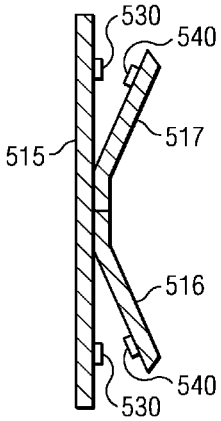

Fastening section (510) is separately (and in the embodiment shown, removably) attachable to both drapery sections (502, 508), and includes front layer (515) and at least one rear layer (516, 517) affixed to the front layer (515) so as to provide upper and lower drapery section receiving pockets (519, 518) between the front and back layers, as shown in FIG. 13*c*. In the embodiment shown, front layer (515) is rectangular strip of material (e.g., a fabric), and a pair of rear layers (516, 517) comprising rectangular strips of material (e.g., fabric) affixed to the rear surface of front layer (515). Rear layers (516, 517) may be affixed to front layer (515) by, for example, stitching or an adhesive. Alternatively, a unitary rear layer may be provided on fastening section (510) by affixing a rectangular strip to front layer (515) along a centerline so as to provide a structure equivalent to that shown in FIG. 13*c*.

The front and rear layers of fastening section (510) are configured and attached to one another so as to provide a downwardly-opening pocket or groove (518) extending along the length of fastening section (510), and an upwardly-opening pocket or groove (519) defined between the front and rear layers of fastening section (510) extending along the length of fastening section (510). Front layer (515) may be sized so as to extend above and below the rear layers (517, 516), respectively. Alternatively, the front and rear layers of fastening section (510) may be coextensive such that the front and rear walls of upwardly-opening pocket (519) have the same height, and the front and rear walls of downwardly-opening pocket (518) have the same height.

Like the embodiments shown in FIGS. 11 and 12, fastening section (510) is configured to retain a cut bottom end portion (505) of top drapery section (502) in upper receiving pocket (519), and to retain a cut upper end portion (509) of lower drapery section (508) in downward (or lower) receiving pocket (518). Thus, one or more fasteners (530, 540) are provided for retaining cut end portions within their respective receiving pockets (518, 519). Any of the various types of fasteners previously described herein may be employed, such as the types described above with respect to FIGS. 11 and 12.

In one particular embodiment, a plurality of magnet members (530) are located in two rows, on a rear surface of front layer (515) adjacent both receiving pockets (519, 518) (similar to the magnet members described in conjunction with FIGS. 11 and 12). Corresponding target members (e.g., ferromagnetic discs) are provided on a front surface of rear layers (516, 517) adjacent receiving pockets (519, 518), in registry with magnet members (530). In this manner, after top and lower drapery sections (502, 508) are cut to the desired length, the cut ends are inserted into receiving pockets (519, 518), respectively, as shown in FIG. 13*d*. The magnet members (530) are magnetically engaged with their corresponding target members (540), through the cut ends of the drapery sections, thereby retaining the cut ends in the receiving pockets.

D. Fastening Section Affixed to Top or Lower Drapery Sections

FIGS. 14-16 depict still other embodiments of fastening sections (601, 611, 621) which may be used in place of, or in addition to, fastening sections (310, 410) described previously. In these embodiments, fastening sections (601, 611, 621) are formed from front and rear layers which are separate from the first and second drapery sections and then are attached permanently to a respective drapery section (e.g., by stitching). Any of the various fasteners, such as magnet and target members (630, 640), may be provided on the front and rear layers of the fastening section, such as previously described with respect to FIG. 11.

Figure 14A:
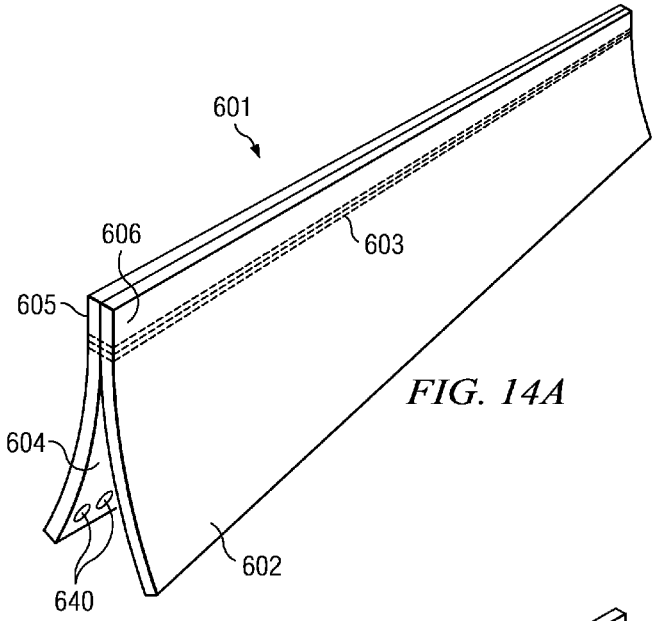
FIGS. 14*a* and 14*b* show an alternative embodiment of a fastening means, and its attachment to a drapery section.
Figure 14B:
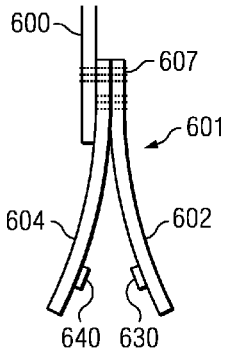

FIG. 14*a* shows a fastening section (601) comprising two strips of material (602, 604) that are attached along respective proximal edges (603, 605) with a permanent attachment (606), such as sewing, stitching, adhesive, and the like. The two strips of material are elongated, typically rectangular, and can be made of the same or different material, including fabric such as sheer fabrics, cloth, or other suitable curtain or drapery material. The fastening section (601) can be then attached to the edge of a drapery section, such as drapery section (600), as shown in FIG. 14*b*, by a permanent attachment (607), which can include sewing, stitching, adhesive, and the like. Fastening section (601) and can replace, for example, the fastening sections (310, 410) described previously.

Figure 15A:
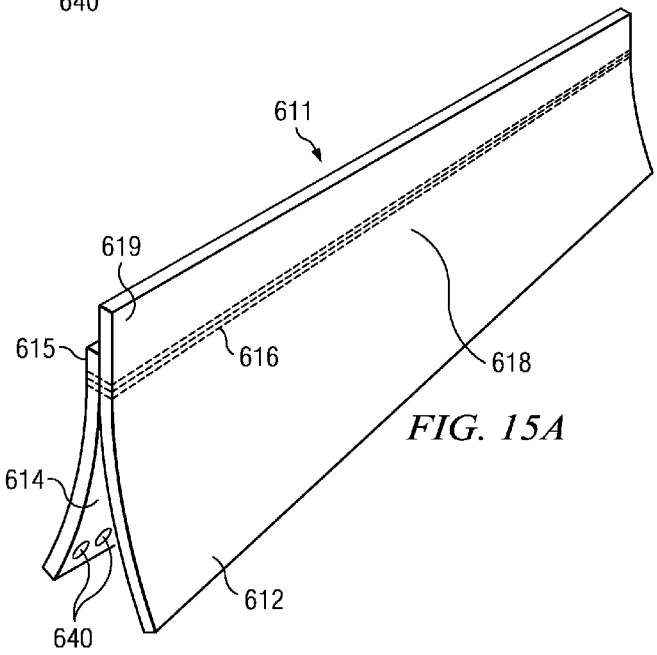
FIGS. 15*a* and 15*b* show another alternative embodiment of a fastening means, and its attachment to a drapery section.
Figure 15B:
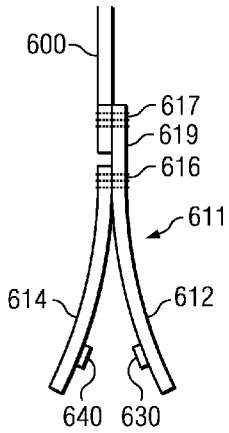

FIG. 15*a* shows an embodiment similar to that of FIG. 14*a*, wherein a fastening section (611) comprises a strip of material (612) that is wider (higher) than that of the strip of material (614). The proximal edge (615) of the strip (614) is attached with a permanent attachment (616) along an intermediate portion (618) of the strip (612), to provide an extending portion (619). The fastening section (611) can be then permanently attached to the edge of a drapery section, such as drapery section (600), along the extending portion (619) as shown in FIGS. 15*b*, by a permanent attachment (617), including sewing, stitching, adhesive, and the like.

Figure 16A:
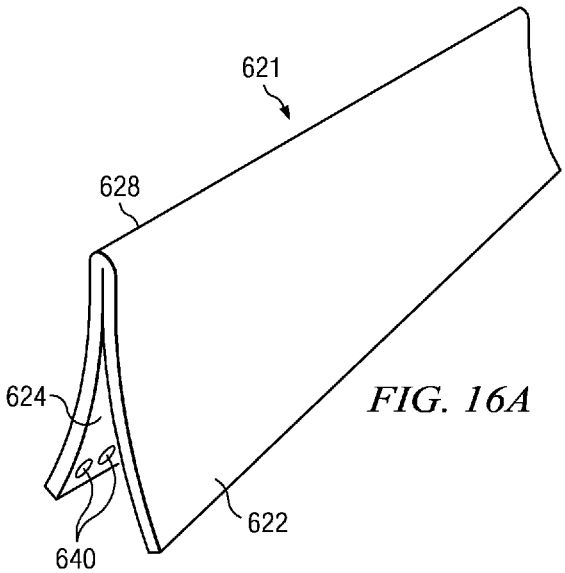
FIGS. 16*a* and 16*b* show a further alternative embodiment of a fastening means, and its attachment to a drapery section.
Figure 16B:
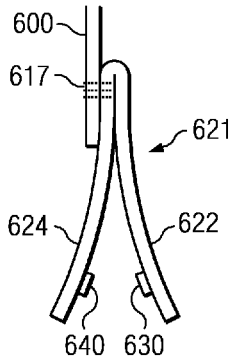

FIG. 16*a* shows a fastening section (621) comprising a single layer of material that is folded along a longitudinal line (628) at about the middle to form two overlapping strips (622, 624) that extend from the proximal fold (628). The fold can be made off the middle so that one strip or the other extends further from the fold line (628). The extending overlapping strips can optionally be attached together along the length of the fold (628) by a permanent attachment, which can include sewing, stitching, adhesive, and the like. The folded fastening section (621) can then be attached to the edge of a drapery section, such as drapery section (600), as shown in FIG. 16*b*, by a permanent attachment (627), including sewing, stitching, adhesive, and the like, that runs through the strip (624), or alternatively though both strips (622, 624).

E. Alternative Fastening Section

Figure 17:
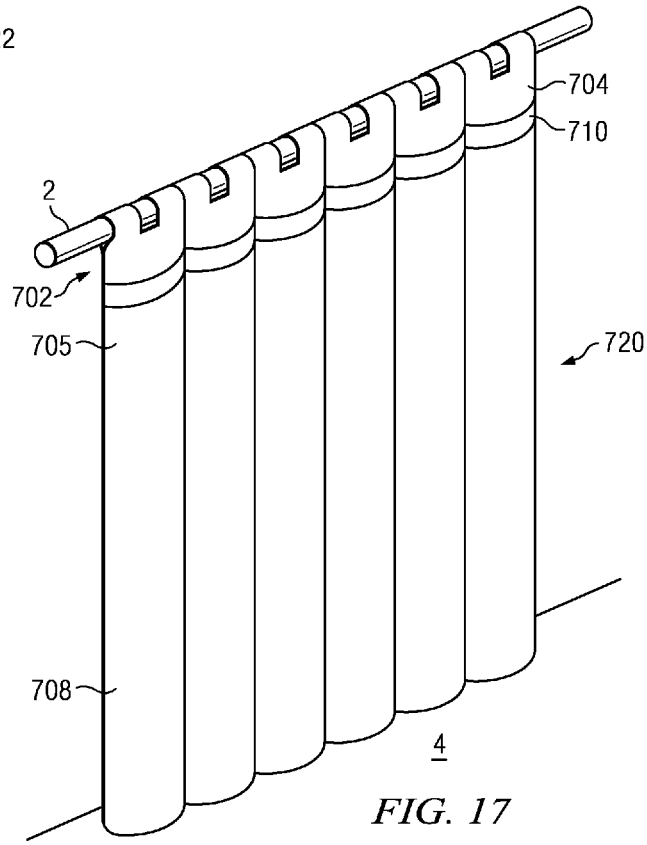
FIG. 17 depicts a perspective view of another embodiment of an assembled drapery system.
Figure 18A:
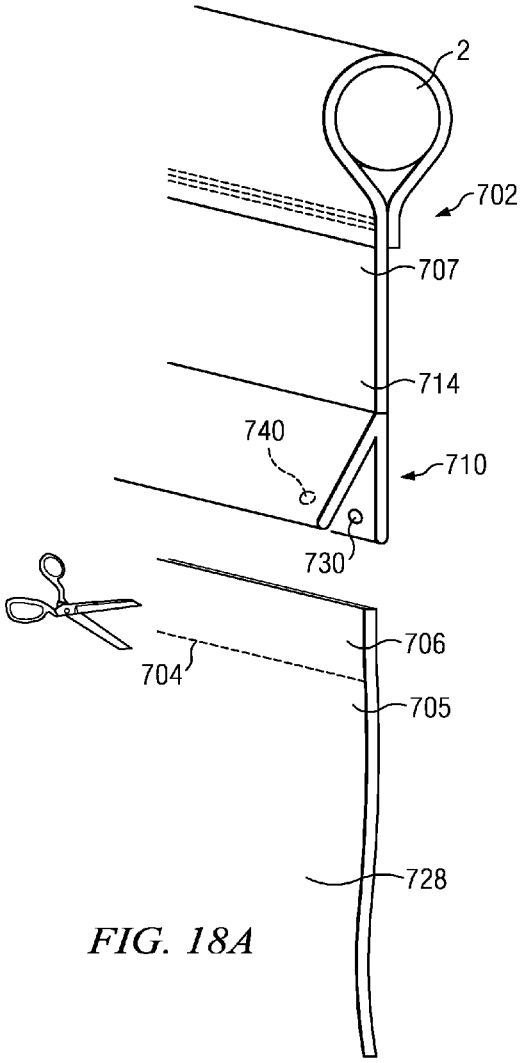
FIGS. 18*a* and 18*b* depict partial side views of the manner in which the drapery system of FIG. 17 is assembled.
Figure 18B:
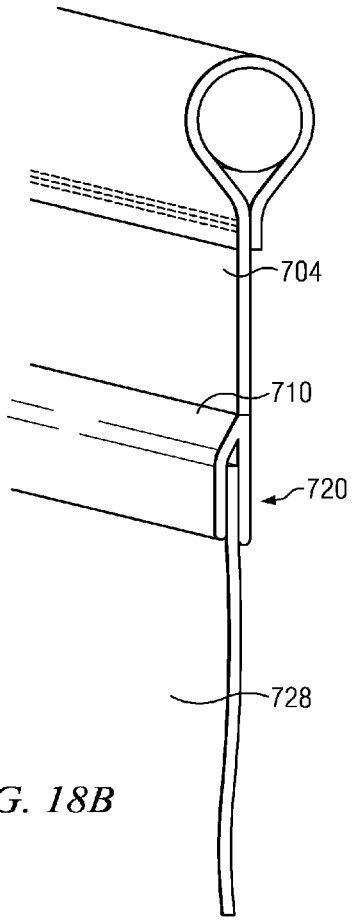

FIGS. 17-18 depict yet another alternative embodiment of a customized drapery system (720) comprising a header drapery section (702) and a lower drapery section (708). The header drapery section (702) includes a heading portion (704) as a short section of drapery that runs along the top of the customized drapery and includes the fixture for mounting the drapery onto a rod. The heading portion (704) can also be pleated as desired. The header drapery section (702) also includes a fastening section (710) fixed along the lower edge (714) of the heading portion (704), and which can be one of the fastening sections described herein above.

The lower drapery section (708) can have a length and a width substantially the same as the header drapery section (702), and includes an upper extra length portion (706) (FIG. 18*a*) that can be removed along any desired line (704), such as with scissors, to shorten the lower drapery section (708) by a desired length, so that the fastening section (710) attaches to the upper end (705) of the resulting lower drapery (708) to form the customized drapery (720) of determined or customized length (FIG. 18*b*), as described herein above. The fastening section (710) can be a fastening section (310, 410, 510), including one of the alternative separate fastening sections (601, 611, 621), described herein above. The fastener elements (630, 640) can be one of the first fastener elements and/or second fastener elements, described herein above, such as magnet and corresponding target members.

IV. Customized Drapery System Having Attached Folded Cut Ends

Figure 19A:
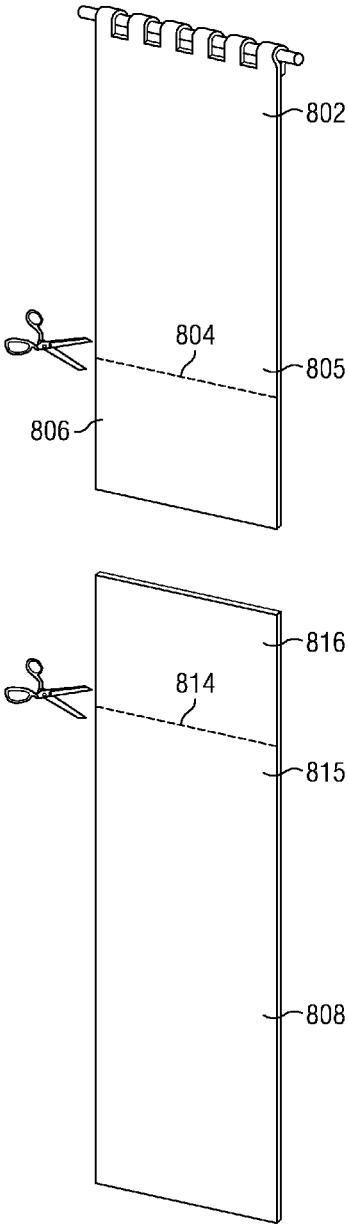
FIGS. 19*a*, 19*b* and 19*c* show another embodiment of a customizable drapery system.
Figure 19B:
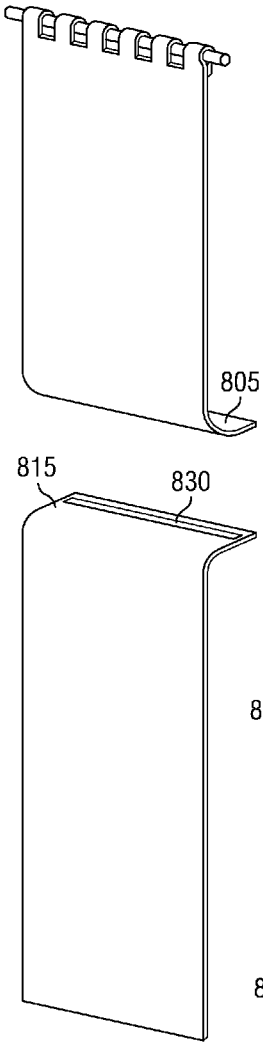
Figure 19C:
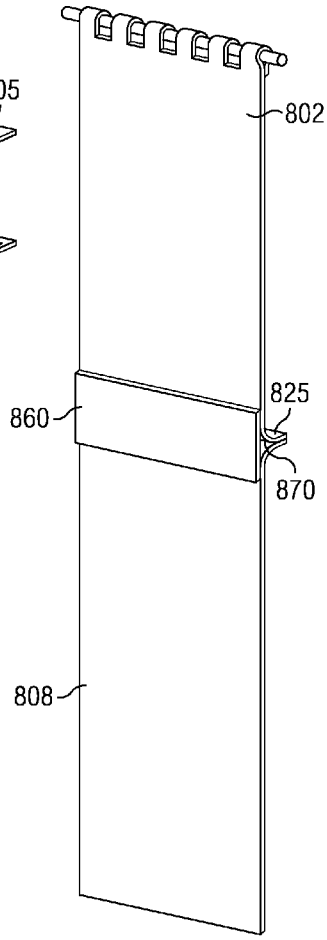

FIGS. 19*a*, 19*b* and 19*c* show yet another customizable drapery system including a top drapery section (802) and a lower drapery section (808), each having front and back surfaces. Both the bottom end portion (806) of top drapery section (802), and the upper end portion (816) of lower drapery section (808) may be cut to the desired length by the end-user along lines (804, 814). Thereafter, the resulting lower end (805) of the top drapery section (802) and the resulting upper end (815) of the lower drapery section (808) are folded under and back as shown in FIG. 19*b*. The folded ends are then overlapped, front face to front face, and fastened together along the respective ends (805, 815) with fastener (830). The fastener (830) may be any of the various types described herein, such as an adhesive strip which the end-user attaches to one (or both) of the cut end portions. A decorative band (860), as described herein, can be optionally attached along the line of joinder (870) of the top drapery section and lower drapery section.

Figure 20A:
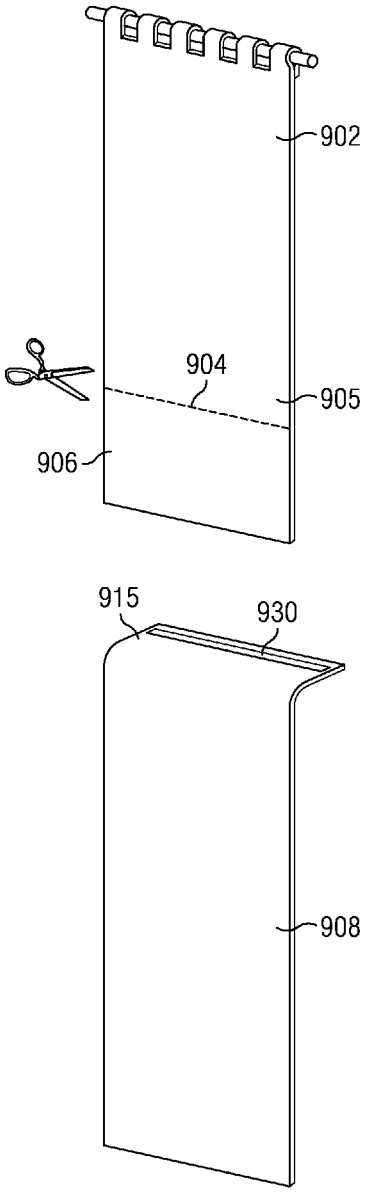
FIGS. 20*a* and 20*b* show an alternative embodiment of a customizable drapery system.
Figure 20B:
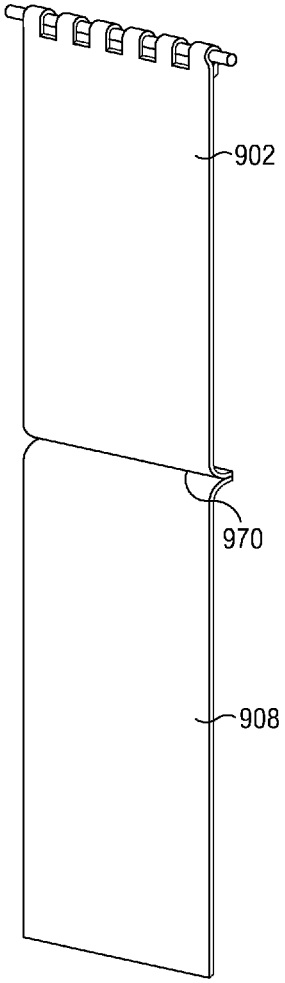

FIGS. 20*a* and 20*b* show a similar embodiment wherein the top drapery section (902) can be cut along line (904) so as to remove bottom end portion (906), while the lower drapery section (908) is not intended to be cut by the end-user (and may be provided in a drapery kit with fastener (930) already attached to upper end (915). The fastener (930) is fixed along the upper end (915) for attaching with the resulting lower end (905) after cutting, in the same manner as in FIG. 19. It will be understand conversely that in an alternative embodiment, the lower drapery section can have the removable extra length portion, while the upper drapery section does not.

It is understood that modifications to the invention may be made as might occur to one with skill in the field of the invention within the scope of the described invention and appended claims. All embodiments contemplated hereunder that achieve the benefits of the invention have therefore not been shown in complete detail. Other embodiments may be developed without departing from the spirit of the invention or from the scope of the appended claims.

While several devices and components thereof have been discussed in detail above, it should be understood that the components, features, configurations, and methods of using the devices discussed are not limited to the contexts provided above. In particular, components, features, configurations, and methods of use described in the context of one of the devices may be incorporated into any of the other devices. Furthermore, not limited to the further description provided below, additional and alternative suitable components, features, configurations, and methods of using the devices, as well as various ways in which the teachings herein may be combined and interchanged, will be apparent to those of ordinary skill in the art in view of the teachings herein.

Having shown and described various versions in the present disclosure, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A drapery system for forming a window drapery of user-selected length, comprising:

(a) a first drapery section having front and back surfaces, and a bottom end portion which terminates in a bottom edge;

(b) a second drapery section having front and back surfaces, and an upper end portion which terminates in an upper edge, said upper end portion configured for overlapping attachment to the bottom end portion of the first drapery section so as to form a window drapery; and (c) at least one fastener located on both the front and back surfaces of said first drapery section proximate the bottom edge of the first drapery section, and at least one fastener located on both the front and back surfaces of said second drapery section proximate the upper edge of the second drapery section for selectively attaching the first and second drapery sections to one another in variably adjustable overlapping relationship such that the back surface of the bottom end portion of the first drapery sections is in facing relationship to the front surface of the upper end portion of the second section, without stitching or sewing the first and second drapery sections to one another, said at least one fastener on the first drapery section and at least one fastener on the second drapery section configured such that an end user can attach the first and second drapery sections to one another at one of a plurality of vertically spaced locations so as to form a drapery having a user-selected length, further comprising a third drapery section comprising a strip of material configured for attachment to either the front surface of the bottom end portion of said first drapery section or the back surface of the upper end portion of the second drapery sections- so as to conceal the edge of the end portion to which it is attached.

2. The drapery system of claim 1, comprising a plurality of said fasteners attached to an end portion of one of said first and second drapery sections.

3. The drapery system of claim 2, wherein said plurality of fasteners are permanently attached to an end portion of one of said first and second drapery sections, at a plurality of vertical distances from the edge of the end portion.

4. The drapery system of claim 1, comprising a plurality of fasteners attached to an end portion of one of said first and second drapery sections, at a plurality of vertical distances from the edge of the end portion to which said fasteners are attached.

5. The drapery system of claim 4, comprising a plurality of fasteners attached to an end portion of both of said first and second drapery sections.

6. A method of adjusting a window drapery to a user-selected length at an on-site location from a drapery system having at least first and second drapery sections, one of which includes a fastening section having a pre-manufactured drapery section receiving pocket defined by front and rear layers of material in the fastening section that are arranged in facing relationship, the pocket being configured to retainably receive a cut end of the other drapery section, the fastening section having top and bottom external surfaces having pre-defined geometries that are independent of the geometry of the other drapery section and at least one fastener, each of the drapery sections having a length and a width, comprising:

(a) determining a desired, user-selected finished length for the window drapery at the on-site location;

(b) adjusting the combined length of the first and second drapery sections at the on-site location by cutting across the width of the drapery section which does not include said fastening section, based on the desired finished length of the window drapery, thereby shortening the length of the cut drapery section; and (c) attaching the cut end of the cut drapery section to the other drapery section at the on-site location, without stitching or sewing, by adjustably inserting the cut end into said receiving pocket of said fastening section and retaining said cut end therein using the at least one fastener so that the receiving pocket obscures any imperfections of the cut end and the positional relationship between the first and second drapery sections can be maintained independent of possible imperfections in the geometry of the cut end whereby a finished completed drapery of user-selected length can be created at the on-site location.

7. The method of claim 6 wherein said at least one fastener comprises at least one strip of adhesive material.

8. The drapery system of claim 1, wherein said third drapery section includes at least one fastener which is configured such that, when said first and second drapery sections are overlappingly attached to one another with said third drapery section attached to an end portion of one of said first and second drapery sections, the at least one fastener of the third drapery section may be used to removably attach the third drapery section to a surface of the other one of said first and second drapery sections.

9. The method of claim 6, wherein said fastening section is permanently affixed to one of said drapery sections, and said cut end of the cut drapery section is removably retained in the receiving pocket of the fastening section by at least one fastener.

10. The method of claim 9, wherein said cut end of the cut drapery section is magnetically retained in the receiving pocket of the fastening section.

11. The method of claim 6, wherein the drapery section which includes said pre-manufactured drapery section receiving pocket comprises a hem member securing portions of the front and rear layers of material together.

12. A method of forming a window drapery of user-selected length from a drapery system having first and second drapery sections, a fastening section, and a plurality of fasteners, wherein each of the drapery sections has a length and a width, and said fastening section has first and second receiving pockets, each of which is configured to retainably receive a cut end of one of said drapery sections, comprising the steps of:

(a) cutting across the width of both the first and second drapery sections, based on a desired length of the window drapery, thereby shortening the length of the cut drapery sections;

(b) attaching said fastening section to the first drapery section by inserting the cut end of the first drapery section into said first receiving pocket of said fastening section and retaining said cut end therein using at least one of said fasteners; and thereafter (c) attaching the cut end of the second drapery section to the first drapery section by inserting the cut end of the second drapery section into said second receiving pocket and retaining the cut end therein using at least one of said fasteners.

13. A method of forming a window drapery of user-selected length from a drapery system having first and second drapery sections, one of which includes a fastening section which defines a drapery section receiving pocket configured to retainably receive a cut end of the other drapery section, and at least one fastener, each of the drapery sections having a length and a width, comprising:

(a) determining a desired length of the window drapery;

(b) cutting across the width of the drapery section which does not include said fastening section, based on the desired length of the window drapery, thereby shortening the length of the cut drapery section; and (c) attaching the cut end of the cut drapery section to the other drapery section, without stitching or sewing, by inserting the cut end into said receiving pocket of said fastening section and retaining said cut end therein using the at least one fastener, wherein said fastening section includes front and rear layers in facing relationship such that said receiving pocket is provided between said layers, and further wherein each of said first and second drapery sections includes an end portion, said cutting step removes the end portion of one of the drapery sections, and one of the layers of said fastening section includes the end portion of the uncut drapery section and the other layer of the fastening section comprises a panel affixed to the uncut drapery section such that the receiving pocket is provided between said panel and the end portion of the drapery section to which the panel is affixed.

14. A method of forming a multi-component window drapery of user-selected length using a finishing drapery component and a further drapery component, the finishing drapery component having a pre-formed pocket configured to receive an altered end of the further drapery component, the pre-formed pocket being defined by front and rear layers of material arranged in facing relationship, the finishing drapery component including external top and bottom edges adjacent to top and bottom surfaces of the pocket, the edges of the top and bottom external surfaces having a pre-defined geometries that are independent of the geometry of the altered end of the further drapery component, the method comprising:

(a) reducing the length of the further drapery component by creating the altered end of the further drapery component;

(b) placing the altered end of the further drapery component into the pre-formed pocket of the finishing component;

(c) with the altered end of the further drapery component placed into the pre-formed pocket, closing the pocket with the altered end of the further drapery component located between the front and rear layers of material defining the pre-formed pocket of the further drapery component; and (d) securing the altered end of the further drapery component in the pre-formed pocket after the altered end of the further drapery component is placed into the pre-formed pocket so as to define the user-selected length of the multi-component window drapery.

15. A method as recited in claim 14 wherein the step of reducing the length of the further drapery component includes cutting an end section off of one end of the further drapery component.

16. A method as recited in claim 14 wherein the step of reducing the length of the further drapery component includes folding the further drapery component.

17. A method as recited in claim 14 wherein the pre-defined geometry of at least one of the external end surfaces of the finishing drapery component is a straight edge.

18. A method as recited in claim 14 wherein the finishing drapery component and the further drapery component each include side edges having pre-defined straight edges, and further including the step of aligning the side edges of the finishing drapery component and the further drapery component prior to securing the cut end of the further drapery component in the pre-formed pocket.

19. A method as recited in claim 14 further including the step of adjusting the length of the multi-component drapery by adjusting the amount by which the altered end of the further drapery is inserted into the pocket prior to securing the altered end of the further drapery in the pre-formed pocket.

20. A method as recited in claim 14 wherein the pre-formed pocket in the finishing drapery component includes upper and lower ends with one the ends being closed ended.

21. A method as recited in claim 14 wherein the finishing drapery component has preformed lateral side edges with predefined geometries.

22. A method as recited in claim 16 wherein both lateral side edges of the finished drapery component are configured as straight lines.

* * * * *